US010421082B2

(12) United States Patent
Luo et al.

(10) Patent No.: US 10,421,082 B2
(45) Date of Patent: Sep. 24, 2019

(54) WATER STOP SWITCH SHOWER HEAD

(71) Applicant: XIAMEN SOLEX HIGH-TECH INDUSTRIES CO., LTD., Xiamen, Fujian (CN)

(72) Inventors: Weilong Luo, Fujian (CN); Donghai Chen, Fujian (CN); Mingfu Zhang, Fujian (CN); Wenxing Chen, Fujian (CN)

(73) Assignee: XIAMEN SOLEX HIGH-TECH INDUSTRIES CO., LTD., Xiamen (CN)

( * ) Notice: Subject to any disclaimer, the term of this patent is extended or adjusted under 35 U.S.C. 154(b) by 148 days.

(21) Appl. No.: 15/386,908

(22) Filed: Dec. 21, 2016

(65) Prior Publication Data

US 2018/0117603 A1 May 3, 2018

(30) Foreign Application Priority Data

Oct. 27, 2016 (CN) ..... 2016 1 0956644

(51) Int. Cl.

| | |
|---|---|
| ***B05B 1/16*** | (2006.01) |
| ***B05B 1/18*** | (2006.01) |
| ***B05B 1/30*** | (2006.01) |
| ***B05B 12/00*** | (2018.01) |

(52) U.S. Cl.

CPC ..... *B05B 1/1636* (2013.01); *B05B 1/18* (2013.01); *B05B 1/3013* (2013.01); *B05B 12/002* (2013.01); *B05B 1/169* (2013.01); *B05B 1/3046* (2013.01)

(58) Field of Classification Search

CPC ..... B05B 1/1636; B05B 1/18; B05B 1/3013; B05B 12/002; B05B 1/3046; B05B 1/169

USPC ..... 239/445, 391, 394, 395, 396, 442, 443, 239/444, 446, 447, 448, 449

See application file for complete search history.

(56) References Cited

U.S. PATENT DOCUMENTS

| | | | | |
|---|---|---|---|---|
| 4,165,837 A * | 8/1979 | Rundzaitis | B05B 1/3026 | 239/394 |
| 4,398,669 A * | 8/1983 | Fienhold | B05B 1/1654 | 239/447 |
| 5,201,468 A * | 4/1993 | Freier | B05B 1/1654 | 239/383 |
| 8,276,833 B2 * | 10/2012 | Cheng | E03C 1/0409 | 239/436 |

(Continued)

*Primary Examiner* — Alexander M Valvis
*Assistant Examiner* — Qingzhang Zhou
(74) *Attorney, Agent, or Firm* — Rabin & Berdo, P.C.

(57) ABSTRACT

A water stop switch shower head includes a water stop element, a water diversion plate, a water diversion body, a switch element and a switch shaft; the switch element is linked to the water diversion plate, the switch element and the water diversion plate rotate respectively around the switch shaft; one end of the water stop element is faced to the water diversion plate; the water diversion plate is disposed with a non-abutting surface and an abutting surface at the surface faced to the water stop element, the non-abutting surface and the abutting surface have height difference transitioned by an incline surface; the switch element is operated to drive the water diversion plate to rotate, when the water stop element faces to the non-abutting surface, the water stop element is contacted with the inner wall of the inlet in sealing way.

18 Claims, 9 Drawing Sheets

(56) References Cited

U.S. PATENT DOCUMENTS

| | | | | |
|---|---|---|---|---|
| 8,297,538 | B2 * | 10/2012 | Zhou | B05B 1/1636 239/391 |
| 8,313,049 | B2 * | 11/2012 | Xu | B05B 1/18 239/280 |
| 2014/0027234 | A1 * | 1/2014 | Zhou | B05B 1/1636 192/43.1 |

* cited by examiner

WATER STOP SWITCH SHOWER HEAD

FIELD OF THE INVENTION

The present invention relates to sanitary ware, especially to a shower head.

BACKGROUND OF THE INVENTION

Existing shower head can adjust the outlet functions by user's switching. During a shower, when the user wants to apply shower gel or shampoo, the shower head should be turned off. If the shower head keeps on, water is wasted. But it is not convenient for the user to switch off the shower head by switching the switch on the wall. A water stop shower head is then existed. The water stop button is disposed in the shower head, user can operate the button to achieve water stop, and the shower head is convenient and humanized. However, traditional water stop shower head has the water stop and switch functions independent, making the shower head with more component and complicated structure. The user needs to distinguish the water stop button and switch button, the cost of study is high, the user experience is bad. Besides, the water stop switch needs large force, the switch hand feel is not good.

SUMMARY OF THE INVENTION

The present invention is provided with a shower head, which can realize water stop and switch functions by a component.

The technical solution of the present invention to solve the technical problem is that:

A water stop switch shower head, wherein comprising a water stop element, a water diversion plate, a water diversion body, a switch element and a switch shaft; the switch element is linked to the water diversion plate, the switch element and the water diversion plate rotate respectively around the switch shaft;

one end of the water stop element is faced to the water diversion plate; the water diversion plate is disposed with a non-abutting surface and an abutting surface at the surface faced to the water stop element, the non-abutting surface and the abutting surface have height difference transitioned by an incline surface; the switch element is operated to drive the water diversion plate to rotate, when the water stop element faces to the non-abutting surface, the water stop element is contacted with the inner wall of the inlet in sealing way; when the water stop element abuts against the abutting surface, the water stop element moves upwardly in the axial direction to disconnect to the inner wall of the inlet;

the water diversion plate is further disposed with a water diversion hole along the extending direction of the abutting surface, the water diversion hole is connected to different outlets of the water diversion body with the rotating of the water diversion plate.

In another preferred embodiment, the switch element comprises a dial button and a pendulum rod; the dial button is disposed at one end of the pendulum rod, the other end of the pendulum rod is a ball base, the ball base is disposed with a through hole connected to the switch shaft in the axial direction; the front end of the ball base extends out with a lock block, the water diversion plate is disposed with a lock base to lock to the lock block.

In another preferred embodiment, the distance between the water diversion plate and the switch shaft is smaller than the distance between the dial button and the switch shaft.

In another preferred embodiment, the ratio of the distance between the dial button and the switch shaft to the distance between the water diversion plate and the switch shaft is 3:1.

In another preferred embodiment, the pendulum rod is disposed with an arc groove, the arc groove is disposed with a least two position holes along the arc; the shower head is disposed with an elastic location pin; the dial button drives the arc groove to rotate around the switch shaft, making the location pin move and switch between the position holes.

In another preferred embodiment, the inlet is disposed at a fixing base and passes through the fixing base; the fixing base and the water diversion body define a water diversion chamber, the water diversion plate is arranged in the water diversion chamber; when the water stop element abuts against the abutting surface, the inlet is connected to the water diversion chamber.

the water stop element is coaxially aligned with the inlet, the end of the water stop element faced to the water diversion plate is exposed out of the inlet; the water stop element has a cavity for receiving an elastic element, one end of the elastic element is fixedly connected to the fixing base and the elastic element is always being compressed; the portion of the water stop element exposed out of the inlet is disposed with a through hole connecting the water diversion chamber and the cavity.

In another preferred embodiment, the fixing base is further disposed with a normal-open decompression hole directly connected to the water diversion plate, the decompression hole is connected to the water diversion chamber.

In another preferred embodiment, the water diversion body is disposed with three outlets arranged in an arc, the center of arc coincides with the switch shaft; the three outlets are outlets for spraying water, shower water and massage water.

In another preferred embodiment, it further comprises a main body, an inlet component and an outlet cover plate; the main body and the outlet cover plate define a chamber, one side of the main body away from the outlet cover plate is disposed with a groove connected to the chamber; the water stop element, the water diversion plate, the water diversion body, the switch element and the switch shaft are disposed in the chamber, a portion of the switch element is exposed out of the main body through the groove.

Compared to the traditional technology, the technical solution of the present invention has following advantages:

1. The water stop switch shower head controls the position of the water stop element to open or close the inlet by the linkage of the switch element and the water diversion plate and the height change of the water diversion plate and the abutting surface of the water stop element. When the inlet is kept open and the water diversion plate rotates continuously, the water diversion hole is connected to different outlets to achieve different outlet functions. Therefore, the water stop and water diversion are achieved by a component, the structure is simple, the functions are rich.
2. The water stop switch shower head of the present invention is provided that the distance of the dial button and the switch shaft is larger, the distance of the water diversion plate and the switch shat is smaller, according to principle of moment, user can apply a small force on the dial button to drive the water diversion plate to rotate to switch, the force is saving, the user experience is well.
3. The water stop switch shower head of the present invention is provided that a through hole is disposed in the water stop element to connect to the cavity of the water stop element, the through hole connects the water diversion chamber and the cavity. When water flows to the water diversion chamber, water in the water diversion chamber flows to the cavity through the through hole, making the abutting end of the water stop element in the water diversion plate subjected to water pressure with equal power and opposite direction to the other end, making the water stop element balanced. The water stop element abuts against the water diversion plate only by the restoring force of the elastic element. Therefore, when water is switched from the water stop state to water diversion state or from the water diversion state to water stop state, the user can only overcome the restoring force of the elastic element, the force is saving, the operation hand feel is well.

DETAILED DESCRIPTION OF THE EMBODIMENTS

Figure 1:
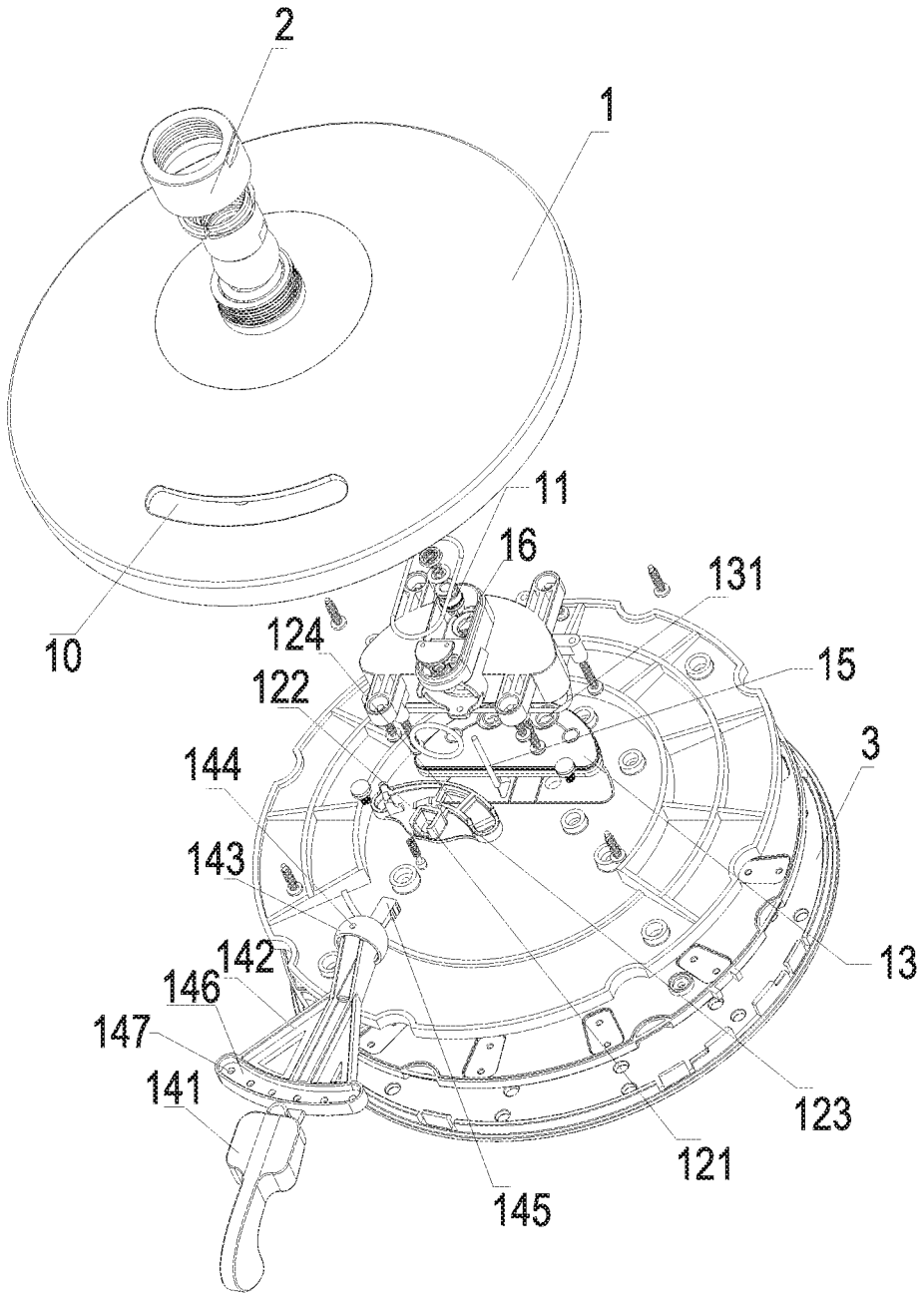
FIG. 1 illustrates an exploded and schematic diagram of a shower head of Embodiment 1 of the present invention.
Figure 2:
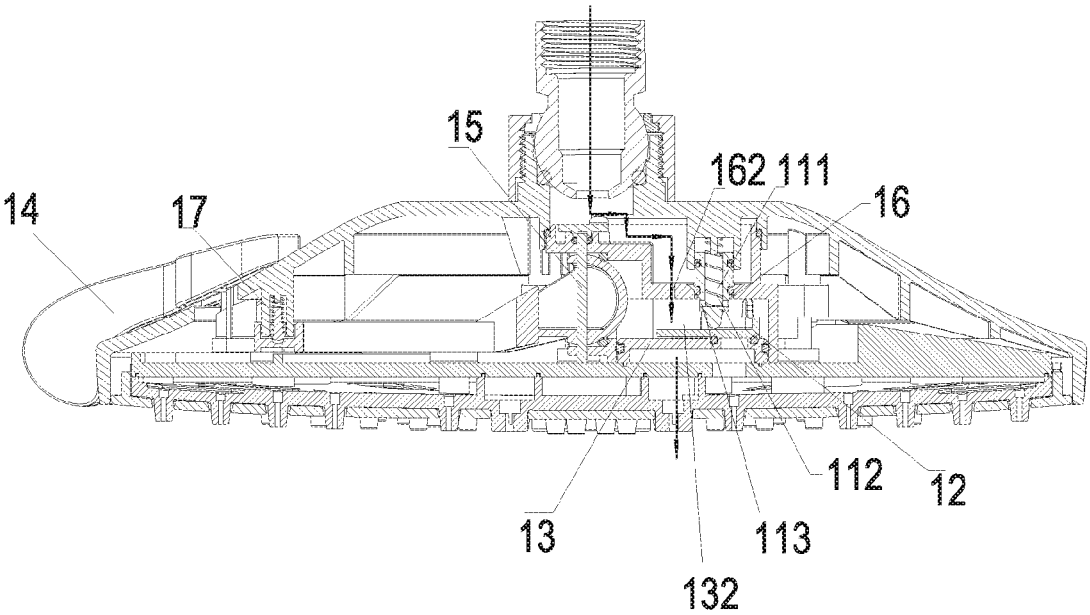
FIG. 2 illustrates a sectional diagram of the shower head in water stop state of Embodiment 1 of the present invention.

The present invention will be further described with the drawings and the embodiments:

Referring to FIG. 1 and FIG. 2, the water stop switch shower head comprises a main body 1, an inlet component 2 and an outlet cover plate 3; the main body 1 and the outlet cover plate 3 define a chamber, one side of the main body 1 away from the outlet cover plate 3 is disposed with a groove 10 connected to the chamber; a water stop element 11, a water diversion plate 12, a water diversion body 13, a switch element 14 and a switch shaft 15 are disposed in the chamber.

The switch element 14 comprises a dial button 141 and a pendulum rod 142; the dial button 141 is disposed at one end of the pendulum rod and is exposed out of the back side of the main body through the groove 10. The other end of the pendulum rod 142 is a ball base 143, the ball base 143 is disposed with a through hole 144 connected to the switch shaft 15 in the axial direction; the front end of the ball base 143 extends out with a lock block 145, the water diversion plate 12 is disposed with a lock base 121 to lock to the lock block 145. With above connection, a user can dial the dial button 141 to drive the pendulum rod 142 and the water diversion plate to rotate around the switch shaft 15.

One end of the water stop element 11 is faced to the water diversion plate 12; the water diversion plate 12 is disposed with a non-abutting surface 122 and an abutting surface 123 at the surface faced to the water stop element 11, the non-abutting surface 122 and the abutting surface 123 have height difference transitioned by an incline surface.

When the water stop element 11 faces to the non-abutting surface 122, the water stop element 11 is contacted with the inner wall of the inlet 16 in sealing way, the shower head is in water stop state; when a user dials the dial button 141, the water diversion plate 12 moves with respect to the water stop element 11, the end of the water stop element 11 faced to the water diversion plate 12 moves along the non-abutting surface towards the abutting surface, during the end of the water stop element 11 faced to the water diversion plate moves to the abutting surface 123 along the incline surface, the water stop element 11 moves upwardly in the axial direction to disconnect to the inner wall of the inlet 16, the inlet 16 is open, the shower head is in water diversion state.

Furthermore, the water diversion plate 12 is further disposed with a water diversion hole 124 along the extending direction of the abutting surface 123, the water diversion hole 124 is connected to different outlets 131 of the water diversion body 13 with the rotating of the water diversion plate 12. Therefore, when the shower head is in water supplying state and the user dials the dial button 141 in the extending direction of the abutting surface continuously, the inlet 16 is always open, water in the inlet 16 flows to different outlets 131 through the water diversion hole 124 to switch different outlet functions.

Therefore, above mentioned water stop switch shower head controls the position of the water stop element 11 to open or close the inlet 16 by the linkage of the switch element 14 and the water diversion plate 12 and the height change of the water diversion plate 12's surface faced to the water stop element 11. when the inlet 16 is kept open and the water diversion plate 12 rotates continuously, the water diversion hole 124 is connected to different outlets 131 to achieve different outlet functions.

Therefore, the water stop and water diversion are achieved by a component, the structure is simple, the functions are rich.

Figure 3:
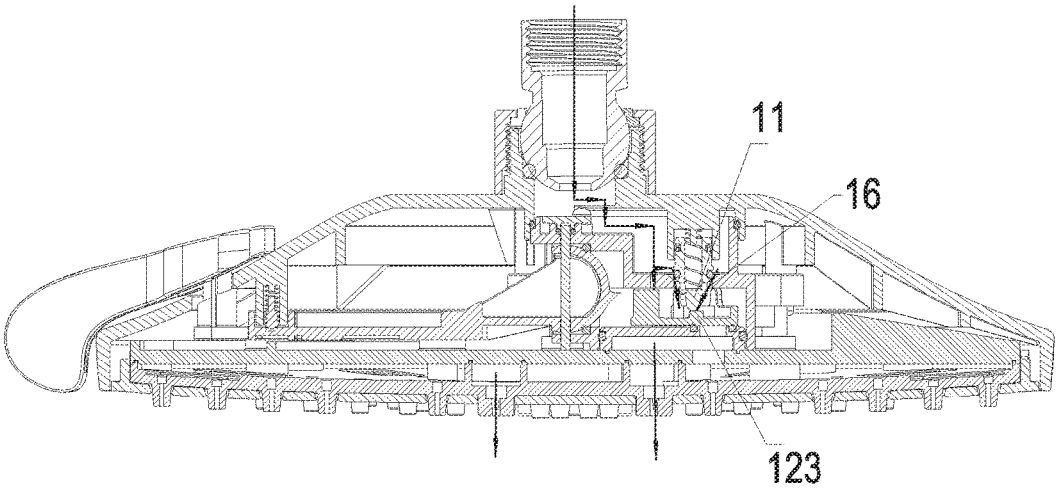
FIG. 3 illustrates a sectional diagram of the shower head with spraying water outlet of Embodiment 1 of the present invention.
Figure 4:
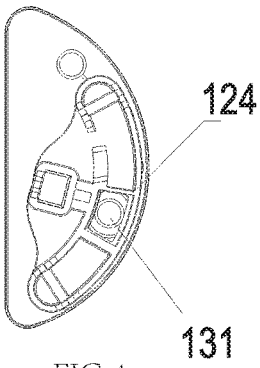
FIG. 4 illustrates a schematic diagram of the water diversion plate and the water diversion body of FIG. 3.
Figure 5:
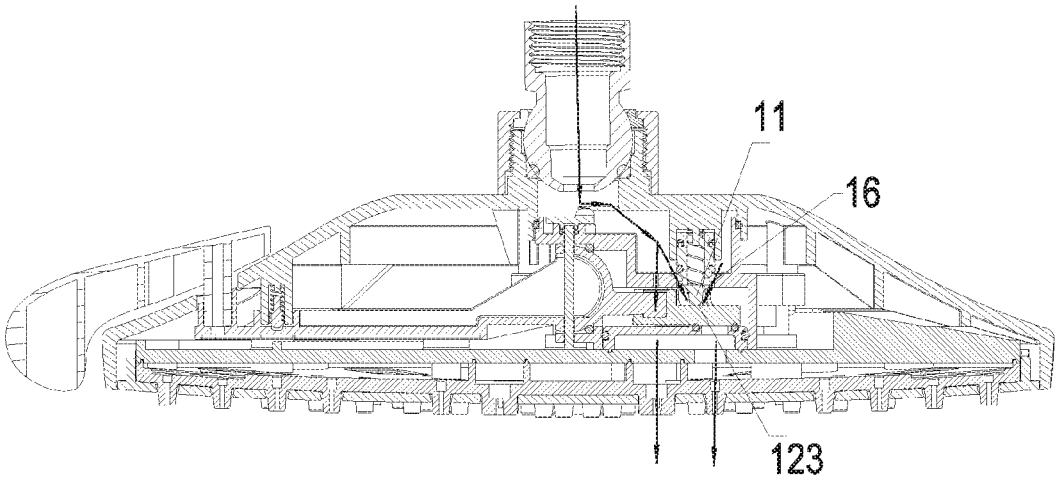
FIG. 5 illustrates a sectional diagram of the shower head with spraying water and shower water outlet of Embodiment 1 of the present invention.
Figure 6:
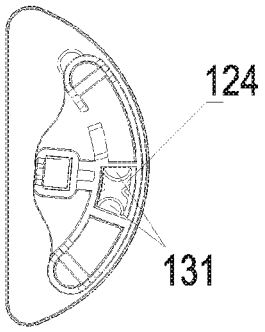
FIG. 6 illustrates a schematic diagram of the water diversion plate and the water diversion body of FIG. 5.
Figure 7:
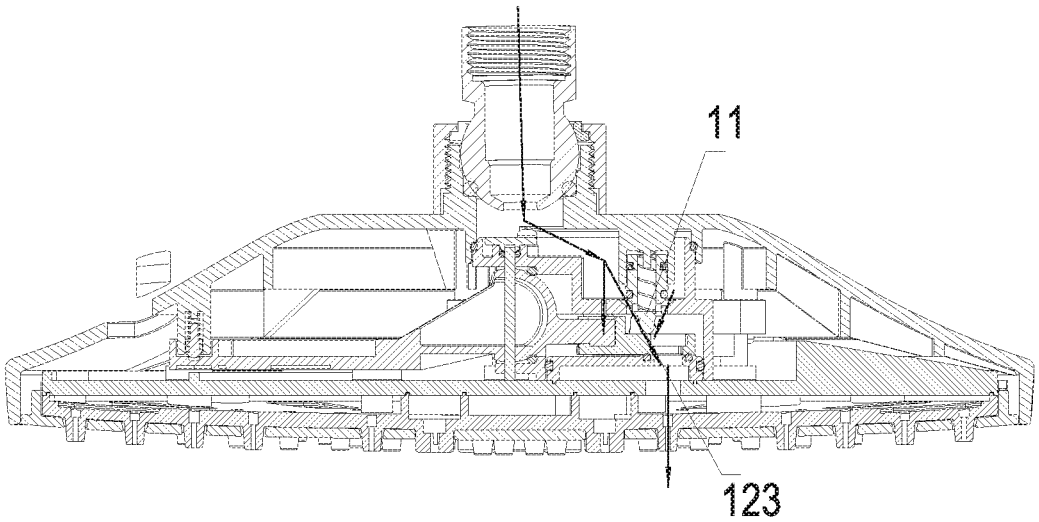
FIG. 7 illustrates a sectional diagram of the shower head with shower water outlet of Embodiment 1 of the present invention.
Figure 8:
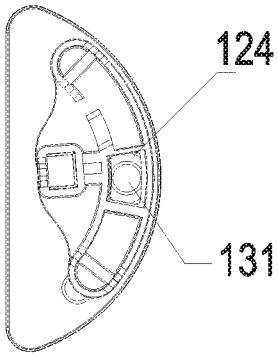
FIG. 8 illustrates a schematic diagram of the water diversion plate and the water diversion body of FIG. 7.
Figure 9:
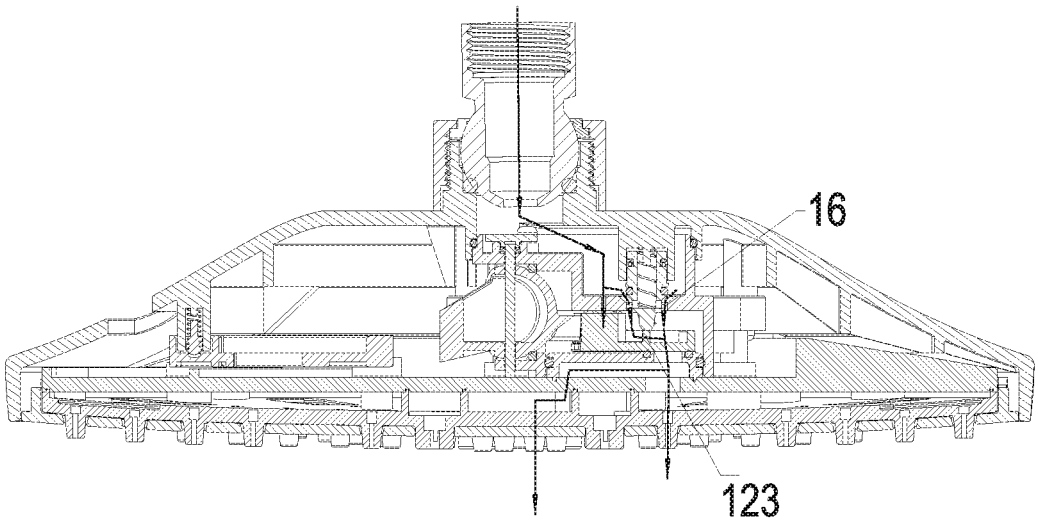
FIG. 9 illustrates a sectional diagram of the shower head with shower water and massage water outlet of Embodiment 1 of the present invention.
Figure 10:
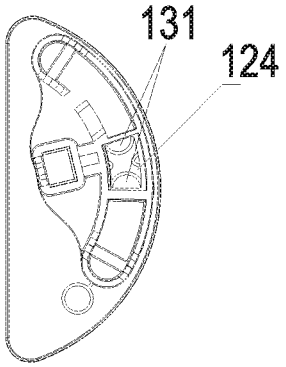
FIG. 10 illustrates a schematic diagram of the water diversion plate and the water diversion body of FIG. 9.
Figure 11:
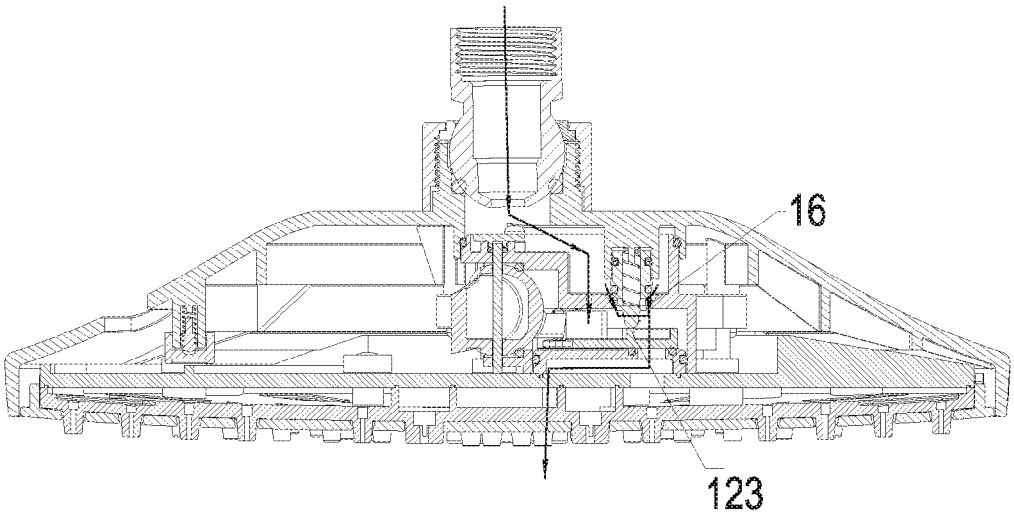
FIG. 11 illustrates a sectional diagram of the shower head with massage water outlet of Embodiment 1 of the present invention.
Figure 12:
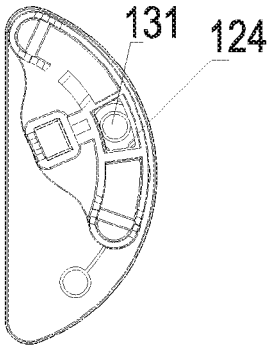
FIG. 12 illustrates a schematic diagram of the water diversion plate and the water diversion body of FIG. 11.

Referring to FIGS. 4-10 further, in this embodiment, the water diversion body 13 is disposed with three outlets 131 arranged in an arc, the center of arc coincides with the switch shaft 15; the three outlets 131 are outlets for spraying water, shower water and massage water. Therefore, when the water diversion hole 124 is connected to the spraying water outlet 131, the shower head outlets spraying water, as figured in FIGS. 3-4. When the water diversion hole 124 is connected to the spraying water outlet and shower water outlet 131 at the same time, the shower head outlets mixing water, as figured in FIGS. 5-6. When the water diversion hole 124 is connected to the shower water outlet 131, the shower head outlets shower water, as figured in FIGS. 7-8. When the water diversion hole 124 is connected to the shower water outlet and massage water outlet 131 at the same time, the shower head outlets mixing water, as figured in FIGS. 9-10. When the water diversion hole 124 is connected to the massage water outlet 131, the shower head outlets massage water, as figured in FIGS. 11-12.

In this embodiment, to reduce the switch operation route and force when the user dials the dial button 141, the distance between the water diversion plate 12 and the switch shaft 15 is smaller than the distance between the dial button 141 and the switch shaft 15. In this embodiment, the ratio value is 3:1. According to principle of moment, user can apply a small force on the dial button 141 to drive the water diversion plate 12 to rotate to switch, the force is saving, the user experience is well.

The pendulum rod 142 is disposed with an arc groove 146, the arc groove 146 is disposed with a least six position holes 147 along the arc; the main body 1 of the shower head is disposed with an elastic location pin 17 with one end fixedly connected to the main body 1 and the other end abutting against the arc groove 146; the dial button 141 drives the arc groove 146 to rotate around the switch shaft 15, making the location pin 17 move and switch between the position holes 147. When the location pin 17 moves to one position hole 147, it impacts with the position hole 147 under the action of the spring and makes a pattering sound, thus providing clear gear cues to the user.

Therefore, above mentioned shower head provides six gears of water stop, spraying water, massage water, shower water, mixing water of shower water and massage water and mixing water of spraying water and shower water. The number of position holes 147 is six correspondingly.

In this embodiment, the inlet 16 is disposed at a fixing base 161 by passing throughout the fixing base 161; the fixing base 161 is further disposed with a normal-open decompression hole 162 directly connected to the water diversion plate 12. Therefore, even the shower head is in water stop state, a small amount of water still flows out of the normal-open decompression hole 162, avoiding over-large of water pressure in the main body 1 of the shower head.

The water stop element 11 is disposed in the axial direction of the inlet 16, the end of the water stop element 11 faced to the water diversion plate 12 is exposed out of the inlet 16; the fixing base 161 and the water diversion body 13 define a water diversion chamber 132, the water diversion plate 12 is disposed in the water diversion chamber 132; the decompression hole 162 is connected to the water diversion chamber 132. When the water stop element 11 abuts against the abutting surface 123, the inlet 16 is connected to the water diversion chamber 132. The water stop element 11 has a cavity 111 for receiving an elastic element 112, one end of the elastic element 112 is fixedly connected to the fixing base 161 and the elastic element 112 is always being compressed; the portion of the water stop element 11 exposed out of the inlet 16 is disposed with a through hole 113 connecting the water diversion chamber 132 and the cavity 111.

Therefore, water flows out of the decompression hole 162 or the inlet 16 flows to the cavity 111 through the through hole 113, making the abutting end of the water stop element 11 in the water diversion plate subjected to water pressure with equal power and opposite direction to the other end, making the water stop element 11 balanced.

The water stop element 11 abuts against the water diversion plate 12 only by the restoring force of the elastic element. Therefore, when water is switched from the water stop state to water diversion state or from the water diversion state to water stop state, the user can only overcome the restoring force of the elastic element 12, the force is saving, the operation hand feel is well.

Embodiment 2

Figure 13:
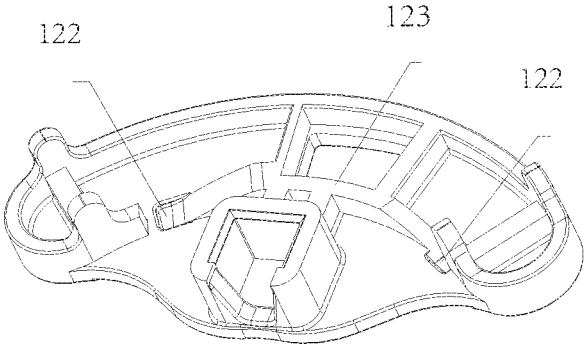
FIG. 13 illustrates a schematic diagram of a water diversion plate of Embodiment 2 of the present invention.

Referring to FIG. 13, in this embodiment, two ends of the abutting surface 123 are respectively connected to a non-abutting surface 122 by an incline surface, therefore, user can dial the dial button 141 towards the left or towards the right to the end to achieve the switch from water diversion to water stop. In addition, the non-abutting surface 122 is a groove, but in Embodiment 1, it is a flat plane. This configuration can reduce the possibility that the end of the water stop element faced to the water diversion plate abuts against the non-abutting surface 122 due to component tolerance accumulation, it also avoids the possibility that a position deviation of the water stop element happens after long time service and the water stop element abuts against the non-abutting surface 122. The structure of the whole shower is stable and reliable.

Embodiment 3

Figure 14:
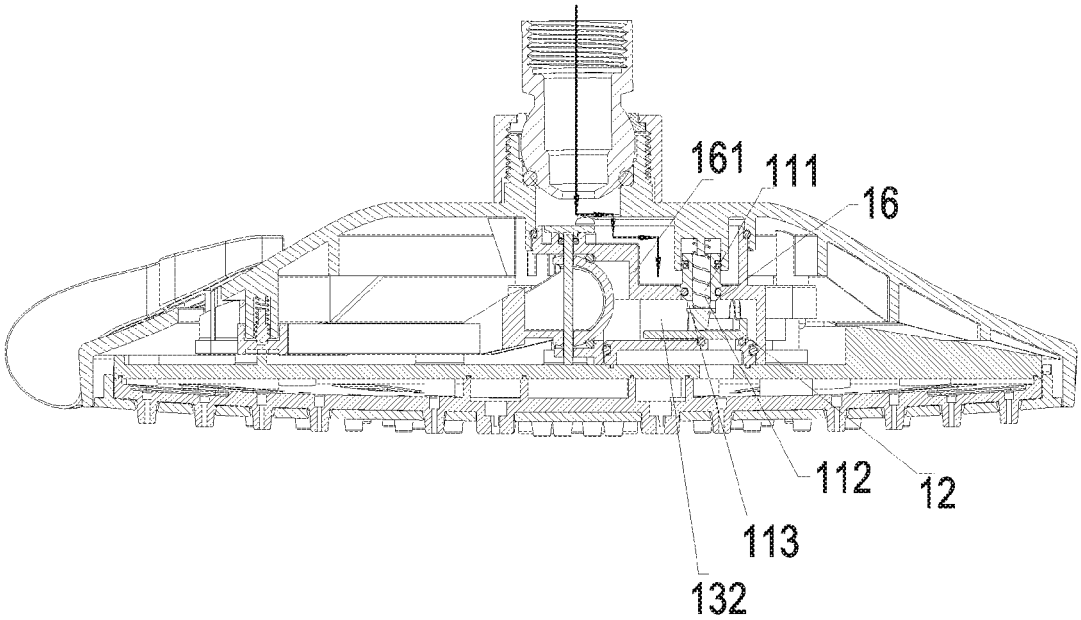
FIG. 14 illustrates a sectional diagram of a shower head in water stop state of Embodiment 3 of the present invention.

Referring to FIG. 14, in this embodiment, the fixing base 161 doesn't have a normal-open decompression hole, when the water stop element 11 is faced to the non-abutting surface 122, the water stop element 11 is contacted to the inner wall of the inlet 16 in sealing way, the shower head is in fully water stop state, no water flows to the water diversion chamber 132, no water exists in the cavity 111 of the water diversion element 11 neither. The water stop element 11 is disposed with two sealing rings up and down, two sealing rings of the water stop element 1 are subjected to water pressure of equal power and opposite direction, making the whole water stop element free of water pressure; the water stop element 11 is only subjected to restoring force of the elastic element 112 such to contact with the inner wall of the inlet 16 in sealing way.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

The invention claimed is:

1. A water stop switch shower head, comprising a water stop element, a water diversion plate, a water diversion body, a switch element and a switch shaft, wherein:

the switch element is linked to the water diversion plate;

the switch element and the water diversion plate rotate respectively around the switch shaft;

one end of the water stop element is faced to the water diversion plate;

the water diversion plate has a non-abutting surface and an abutting surface at a surface faced to the water stop element;

the non-abutting surface and the abutting surface have a height difference transitioned by an incline surface;

the switch element is operated to drive the water diversion plate to rotate;

when the water stop element faces to the non-abutting surface, the water stop element is contacted with an inner wall of an inlet in a sealing way;

when the water stop element abuts against the abutting surface, the water stop element moves upwardly in an axial direction to disconnect from the inner wall of the inlet;

the water diversion plate further has a water diversion hole along an extending direction of the abutting surface; and the water diversion hole is connected to different outlets of the water diversion body with the rotating of the water diversion plate.

2. The water stop switch shower head according to claim 1, wherein:

the switch element comprises a dial button and a pendulum rod;

the dial button is disposed at one end of the pendulum rod;

another end of the pendulum rod is a ball base;

the ball base has a through hole connected to the switch shaft in the axial direction;

a front end of the ball base extends out with a lock block; and the water diversion plate has a lock base to lock to the lock block.

3. The water stop switch shower head according to claim 2, wherein a distance between the water diversion plate and the switch shaft is smaller than a distance between the dial button and the switch shaft.

4. The water stop switch shower head according to claim 3, wherein a ratio of the distance between the dial button and the switch shaft to the distance between the water diversion plate and the switch shaft is 3:1.

5. The water stop switch shower head according to claim 4, wherein:

the pendulum rod has an arc groove;

the arc groove has at least two position holes along the arc;

the shower head has an elastic location pin; and the dial button drives the arc groove to rotate around the switch shaft, making the location pin move between the position holes.

6. The water stop switch shower head according to claim 1, wherein:

the inlet is disposed at a fixing base and passes through the fixing base;

the fixing base and the water diversion body define a water diversion chamber;

the water diversion plate is arranged in the water diversion chamber; and when the water stop element abuts against the abutting surface, the inlet is connected to the water diversion chamber.

7. The water stop switch shower head according to claim 6, wherein:

the water stop element is coaxially aligned with the inlet;

an end of the water stop element faced to the water diversion plate is exposed out of the inlet;

the water stop element has a cavity for receiving an elastic element;

one end of the elastic element is fixedly connected to the fixing base and the elastic element is always being compressed; and a portion of the water stop element exposed out of the inlet has a through hole connecting the water diversion chamber and the cavity.

8. The water stop switch shower head according to claim 7, wherein:

the fixing base further has a normal-open decompression hole directly connected to the water diversion plate; and the decompression hole is connected to the water diversion chamber.

9. The water stop switch shower head according to claim 1, wherein:

the water diversion body has three outlets arranged in an arc;

a center of the arc coincides with the switch shaft; and the three outlets are outlets for spraying water, shower water and massage water.

10. The water stop switch shower head according to claim 1, further comprising a main body, an inlet component and an outlet cover plate; wherein:

the main body and the outlet cover plate define a chamber;

one side of the main body away from the outlet cover plate has a groove connected to the chamber;

the water stop element, the water diversion plate, the water diversion body, the switch element and the switch shaft are disposed in the chamber; and a portion of the switch element is exposed out of the main body through the groove.

11. The water stop switch shower head according to claim 2, further comprising a main body, an inlet component and an outlet cover plate; wherein:

the main body and the outlet cover plate define a chamber;

one side of the main body away from the outlet cover plate has a groove connected to the chamber;

the water stop element, the water diversion plate, the water diversion body, the switch element and the switch shaft are disposed in the chamber; and a portion of the switch element is exposed out of the main body through the groove.

12. The water stop switch shower head according to claim 3, further comprising a main body, an inlet component and an outlet cover plate; wherein:

the main body and the outlet cover plate define a chamber;

one side of the main body away from the outlet cover plate has a groove connected to the chamber;

the water stop element, the water diversion plate, the water diversion body, the switch element and the switch shaft are disposed in the chamber; and a portion of the switch element is exposed out of the main body through the groove.

13. The water stop switch shower head according to claim 4, further comprising a main body, an inlet component and an outlet cover plate; wherein:

the main body and the outlet cover plate define a chamber;

one side of the main body away from the outlet cover plate has a groove connected to the chamber;

the water stop element, the water diversion plate, the water diversion body, the switch element and the switch shaft are disposed in the chamber; and a portion of the switch element is exposed out of the main body through the groove.

14. The water stop switch shower head according to claim 5, further comprising a main body, an inlet component and an outlet cover plate; wherein:

the main body and the outlet cover plate define a chamber;

one side of the main body away from the outlet cover plate has a groove connected to the chamber;

the water stop element, the water diversion plate, the water diversion body, the switch element and the switch shaft are disposed in the chamber; and a portion of the switch element is exposed out of the main body through the groove.

15. The water stop switch shower head according to claim 6, further comprising a main body, an inlet component and an outlet cover plate; wherein:

the main body and the outlet cover plate define a chamber;

one side of the main body away from the outlet cover plate has a groove connected to the chamber;

the water stop element, the water diversion plate, the water diversion body, the switch element and the switch shaft are disposed in the chamber; and a portion of the switch element is exposed out of the main body through the groove.

16. The water stop switch shower head according to claim 7, further comprising a main body, an inlet component and an outlet cover plate; wherein:

the main body and the outlet cover plate define a chamber;

one side of the main body away from the outlet cover plate has a groove connected to the chamber;

the water stop element, the water diversion plate, the water diversion body, the switch element and the switch shaft are disposed in the chamber; and a portion of the switch element is exposed out of the main body through the groove.

17. The water stop switch shower head according to claim 8, further comprising a main body, an inlet component and an outlet cover plate; wherein:

the main body and the outlet cover plate define a chamber;

one side of the main body away from the outlet cover plate has a groove connected to the chamber;

the water stop element, the water diversion plate, the water diversion body, the switch element and the switch shaft are disposed in the chamber; and a portion of the switch element is exposed out of the main body through the groove.

18. The water stop switch shower head according to claim 9, further comprising a main body, an inlet component and an outlet cover plate; wherein:

the main body and the outlet cover plate define a chamber, one side of the main body away from the outlet cover plate has a groove connected to the chamber;

the water stop element, the water diversion plate, the water diversion body, the switch element and the switch shaft are disposed in the chamber; and a portion of the switch element is exposed out of the main body through the groove.

* * * * *